US007240443B2

(12) United States Patent
Nathanson et al.

(10) Patent No.: US 7,240,443 B2
(45) Date of Patent: Jul. 10, 2007

(54) INFORMATION ORGANIZATION PRODUCT AND METHOD

(75) Inventors: Theodore Nathanson, Scarsdale, NY (US); Craig Adam Nathanson, Bronxville, NY (US)

(73) Assignee: Aha! Concepts Inc., Scarsdale, NY (US)

( * ) Notice: Subject to any disclaimer, the term of this patent is extended or adjusted under 35 U.S.C. 154(b) by 0 days.

(21) Appl. No.: 10/676,367

(22) Filed: Oct. 1, 2003

(65) Prior Publication Data

US 2005/0072033 A1 Apr. 7, 2005

(51) Int. Cl.
*G09F 1/00* (2006.01)

(52) U.S. Cl. ..... 40/124.06; 40/360; 40/661; 229/71; 283/901

(58) Field of Classification Search ..... 40/124.01, 40/124.06, 360, 661, 341; 229/71, 67.4; 402/73, 80 P, 80 R; 283/901; D19/3, 27, D19/33

See application file for complete search history.

(56) References Cited

U.S. PATENT DOCUMENTS 2,819,010 A * 1/1958 Amiguet ..... 383/93
4,301,919 A * 11/1981 Morgan ..... 206/223
4,784,508 A * 11/1988 Shannon ..... 402/79
5,087,079 A * 2/1992 Morris, Jr. ..... 462/8
5,461,810 A * 10/1995 Goserud ..... 40/661
5,667,248 A * 9/1997 Mayer ..... 283/67
5,795,089 A * 8/1998 Ong ..... 402/79
6,632,042 B1 * 10/2003 Liener Chin et al. ..... 402/79
2003/0211268 A1 * 11/2003 Hillemann et al. ..... 428/40.1

* cited by examiner

*Primary Examiner*—Gary C. Hoge
(74) *Attorney, Agent, or Firm*—Lieberman & Brandsdorfer, LLC

(57) ABSTRACT

A method wherein an indicia is selected from one of diverse indicia sources that promotes an informational application, a holder may be selected from a holder source specialized for the given application, and a display is selected from a display source. The indicia is placed in a suggested manner in the display or the indicia and holder unit are placed in the display such that the desired information is displayed. The flap portions of the display are manipulated to expose or conceal releasable, reusable adhesive portions, to suit the carrying of the display appliance, as in a book or bag, or the display of the display appliance from either side in a vertical or horizontal position, as on a cabinet, or wall. An easel insert oir easel attachment allows for a standing position on a counter top or table. A display is made from a flexible and transparent material such as a clear plastic sheet material, having a pocket portion and one or more flap portions, said pocket portion for receiving a combined holder made of a substantially rigid material and having provision to accept an indicia of a substantially flimsy material. The indicia and/or indicia are in a format suggesting or compelling the display of certain display information when assembled, and concealing certain other concealed information until it is disassembled for storage. The flap portions contain regions of releasable, reusable adhesive which may be exposed or concealed when desired. Double-sided adhesive cut-outs may also be used to adhere the indicia to the holder and display.

1 Claim, 7 Drawing Sheets

INFORMATION ORGANIZATION PRODUCT AND METHOD

BACKGROUND OF THE INVENTION

1. Field of the Invention

The present invention relates to systems and methods for storing, organizing, indexing, retrieving, and displaying information, and in particular, to a method wherein an indicia can be stored in a pocket, bag or binder by use of a display appliance utilizing a plurality of releasable adhesive structures for removably securing to a surface.

2. Description of the Background

Methods of storing, retrieving, indexing, and displaying information are of increasing importance in the modern world. There is presently great emphasis on electronic, computer, and Internet methods of achieving these ends. However, there would also be great advantage to providing a method that does not require, yet can still be implemented with and enhanced by, these newer technologies.

Also, there are occasions in which the information desired to be displayed cannot be the product of an electronic, computer, or Internet process. Persons in remote or rugged sites, such as consulting schedules at the top of a skyscraper under construction, or classifying plant life in a rain forest, cannot easily carry electronic or computer devices, and cannot easily connect to the Internet to retrieve information. Some persons do not have the financial resources or training to purchase and operate such electronic equipment. Some persons, due to age or impairment, cannot conveniently operate electronic and computer devices. It is therefore desirable to provide an inexpensive and facile alternative, for the following applications:

(a) Professionals: It would be of great advantage to persons in fields such as law and medicine to have the benefit of information stored and displayed in this format without having to carry or consult electronic devices, which can be broken, and are a desirable target of thieves. It should also be noted that many courthouses and an increasing number of public buildings do not permit the carrying of portable computers or other devices that can interrupt proceedings or disguise a weapon.

(b) Workers: Like persons employed in knowledge or professional tasks, manual laborers also frequently must consult and mark a chart or checklist in the execution of their work. By way of example, an electrician or repairman must keep track of circuits that are live and those that are locked down and tagged out, to prevent accidental electrocution. Such a display containing that information can then adhere to the equipment or adjacent surface to be conveniently consulted by someone of another trade or another shift.

By way of example, U.S. Pat. No. 5,687,496 to McEnroe discloses a sheet protector product having tabs for attachment to the liner of a construction hard hat. It is intended for the insertion of a single indicia containing information such as telephone numbers. While it does protect indicia and is of economical manufacture, it is not designed for the easy changing of indicia. Its system of notches and tabs to secure the sheet protector to the liner only works in the context of construction hard hats, and is intended solely for construction work sites. The disclosed product does not anticipate the provision of a series of integrated methods for storing, retrieving, indexing, and displaying information.

(c) Hobbyists: Hobbyists who go to trade shows or other meetings for the purpose of buying and selling their wares must also have information about the values of items, and maintain lists of items they wish to buy or sell, and have similar informational storage and display needs to those persons listed elsewhere. Furthermore, hobbyists often must display and protect the actual collectable items, in such a manner that the item itself bears the desired application information. Examples of this application include, but are not limited to: stamps, paper money, sports cards, game cards, postcards, autographs, and photographs. While there are prior art references demonstrating this demand and disclosing products to meet this demand, none feature releasable, reusable adhesive portions that can be revealed or concealed as desired, allowing viewing from either side of the see-through display.

(d) Homemakers: Persons doing work in the home have a great desire to efficiently gather, organize, save, and retrieve information such as recipes and articles. Furthermore, like some hobbyists the indicia intended to be displayed may have intrinsic value, such as a recipe handed down from earlier generations, and protection from wear or damage may be desired.

By way of example, U.S. Pat. No. 4,696,491 to Stenger discloses an information reference book in the form of a loose-leaf binder housing information and an indexing system. Such a manual storage organizer can be one component of a system which stores indicia, holders, and displays for an application, and can serve as an indicia source, holder source, or display source. However, this information and indexing system does not satisfy the objectives of displaying and protecting information, and does not compel use of the system to display promotional of other thematic information.

(e) Students: Students at all levels-elementary, secondary, collegiate, graduate, and post-graduate-all require some level of rote memorization of educational material. Several formats are used for this purpose, such as workbooks and audio cassettes. One well known prior art method is the flash card, which presents a small learning objective on a relatively small piece of rigid paperboard. Related flash cards for a single purpose are packaged as a set. It would be very desirable and to great commercial advantage to provide indicia of the type presently presented as flash cards, in a format amenable to being sold as a tablet with a cardboard backing and top binding, or as a perforated sheet amenable to bulk mailing at low cost, or as a sheet marked for cutting printed from an online source such as a web site.

Interactive online media therefore become amenable to be incorporated in this manner as well. The results of a test may be translated by a human instructor or by a computer program into cards designed to enhance the learning of a particular student, by stressing weak areas of the subject matter, for example. Any of a large number of well known prior art methods of deciding how to customize the instruction of students may be implemented in this manner.

In light of the above, it is therefore highly desirable and commercially advantageous to provide a system to fulfill these diverse information storage and retrieval needs with a single product having ease of use and economical manufacture. In so doing, information providers can supply the product along with the information, on a subscription basis or otherwise. It is further desirable that the sponsor or provider of the system have opportunity to provide identity, public relations, promotional, or advertising information in proximity to the useful information provided. Ample precedent in the prior art establishes the desirability of this format. By way of example, if a number of paper indicia, such as a series of flash cards or other memory retention systems, are to be used in the present embodiment, they can be packaged and stored in a file or folder, and the top portion may contain index information that would not be needed when the indicia is being used.

SUMMARY OF THE INVENTION

It is therefore an object of the present invention to provide a system for storing, organizing, indexing, retrieving, and displaying information wherein an indicia is protected by a clear two-sided display appliance that incorporates a releasable, reusable adhesive portion for attachment to a surface, allowing for viewing of either side of the display, in either a vertical or horizontal position.

It is a further object of the present invention to provide a system for storing, organizing, indexing, retrieving, and displaying information wherein a releasable, reusable adhesive portion may be presented or concealed based on the desired use.

It is a further object of the present invention to provide a method for the display and protection of an indicia wherein said indicia may come from a wide variety of sources and media.

It is a further object of the present invention to provide a system for storing, organizing, indexing, retrieving, and displaying information in a proprietary format which suggests or compels the display of displayed holder information and displayed indicia information upon assembly.

It is still another object of the present invention to provide a system for storing, organizing, indexing, retrieving, and displaying information that can be easily attached to a vertical flat surface or stand upon a counter top or table.

It is a further object of the present invention to provide a product that upon assembly in a facile manner, displays desired display information in an indicia and a holder, and may be disassembled in a likewise facile manner.

These and other objects are accomplished by the provision and completion of a method wherein an indicia is selected from one of diverse indicia sources that promotes an informational application, a holder is selected from a holder source specialized for the given application, and a display is selected from a display source. The indicia is placed in a suggested manner against the holder, and the indicia and holder unit is placed in the display such that the desired information is displayed. Portions of the display are manipulated to expose or conceal releasable, reusable adhesive portions, to suit the carrying of the display appliance, as in a ring binder, book or bag, or the display of either side of the display appliance in a vertical or horizontal hanging position, as on a cabinet or wall, or table top.

These and other objects are further accomplished by the provision of a display made from a flexible and transparent material such as a clear plastic sheet material, having pocket portion and one or more tab portions, said pocket portion for receiving a combined holder made of a substantially rigid material and having provision to accept an indicia of a substantially flimsy material. The holder and indicia are in a format suggesting or compelling the display of certain display information when assembled. The holder may be printed with decorative designs, company logos, slogans, and/or information related to the indicia subject text. Tab portions contain regions for releasable, reusable adhesive which may be exposed or concealed when desired. In addition, double-faced adhesive cut-outs may be used to position and adhere indicia to the holder and display.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
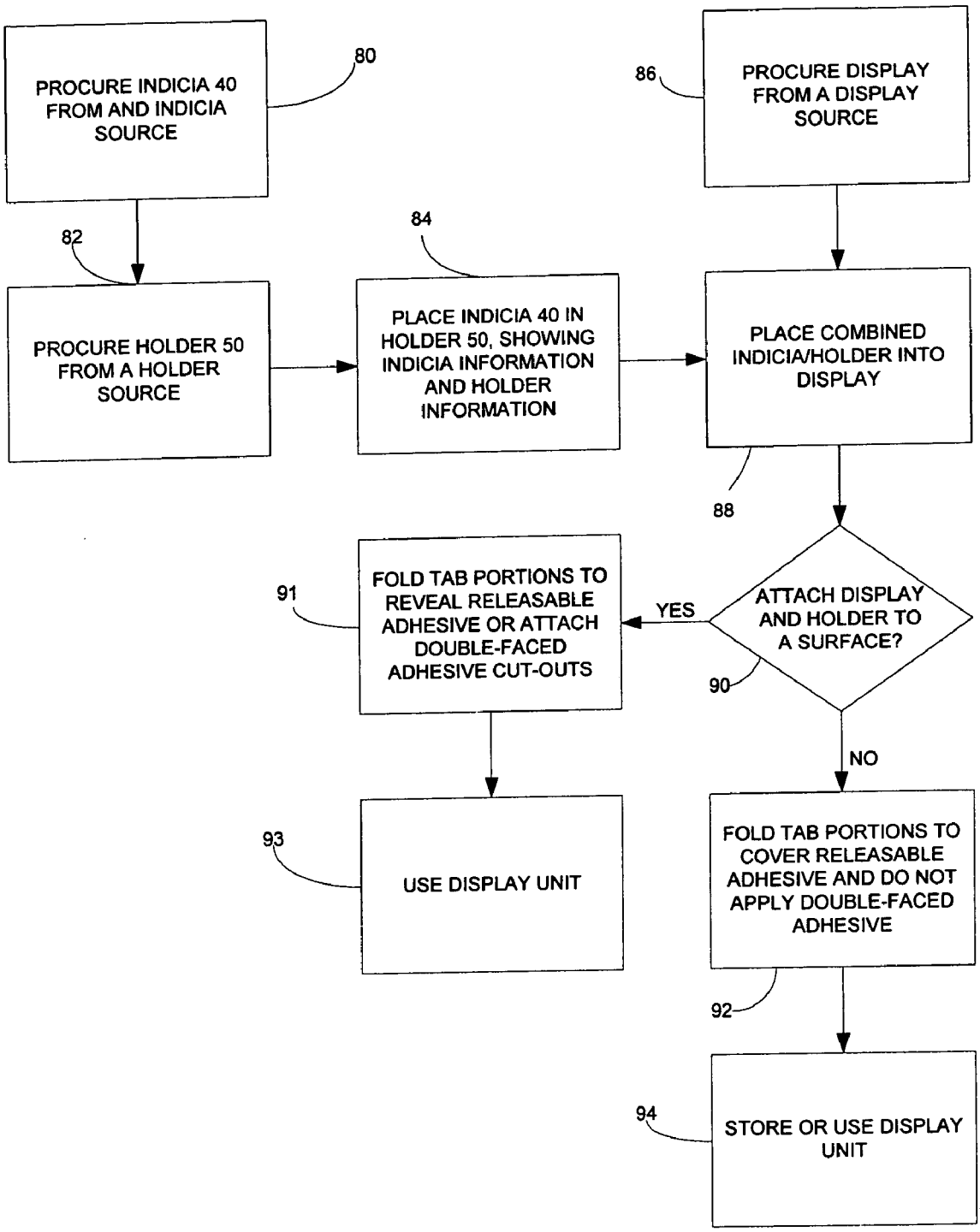
FIG. 1 is a flow diagram of a method of using an information organizing and storage product of the present invention.

Referring now to FIG. 1, and in a preferred embodiment of the present invention, one or more indicia 40 representing a tangible substantially flexible piece of information sought to be stored, organized, indexed, retrieved and displayed are procured from a source of such indicia, in step 80. Said indicia source may be a newspaper or periodical section, a recipe, a tablet of flash cards, a photograph, or a printout from an Internet application, but is not limited to these sources. In a preferred embodiment of the present invention, indicia source is a retail subscription or a feature found in an existing periodical subscription.

In step 82, an indicia holder 50 is procured from a holder source, and in step 84, the indicia 40 is placed in the holder 50 and secured in one of a variety of manners set forth herein, to comprise a combined indicia 40 and holder 50.

An indicia display 20 is acquired from a display source in step 86, and the combined indicia 40 and holder 50 are inserted in the display 20 in step 88, in such a manner as to show the desired indicia information and holder information from either side, protect said information, and permit the application of the display 20 to a surface if desired. The holder source and said display source may be the same, and may be in the form of a flat surface for adhering to a cabinet or wall, or as an easel for placing on a table or counter top.

In step 90, a decision is made to conceal or reveal adhesive portions for the particular application desired. If adhesive application to a surface is desired, one or more tab portions 30 of display 20 are folded in a manner to reveal releasable, reusable adhesive portions for the application to view display from either side in step 91, and the resulting storage and display product 10 is used in step 93. In lieu of the releasable adhesive portions, a series of double-faced adhesive cut-outs may be attached. If adhesive application to a surface is not desired, tab portions 30 of display 20 are folded in another manner to conceal releasable adhesive portions in step 92, and the resulting storage and display product 10 is used in step 94.

In this manner, the storage and display product 10 is effective despite the diversity of indicia sources, because the holder source and display source have designed a coordinated format for the given application. By way of example, if the application is the provision and organization of food recipes and nutritional information in a proprietary format, a provider can simultaneously operate a retail display, a book, a periodical insert card, a periodical column, an Internet site, and a direct mail flyer as indicia sources at the same time, all of which indicia sources are usable by the same holder 50 and display 20 for a consistent application. Holder source and display source may be said retail display, a premium mailed upon subscription to a periodical, or packaged with a book.

Figure 2:
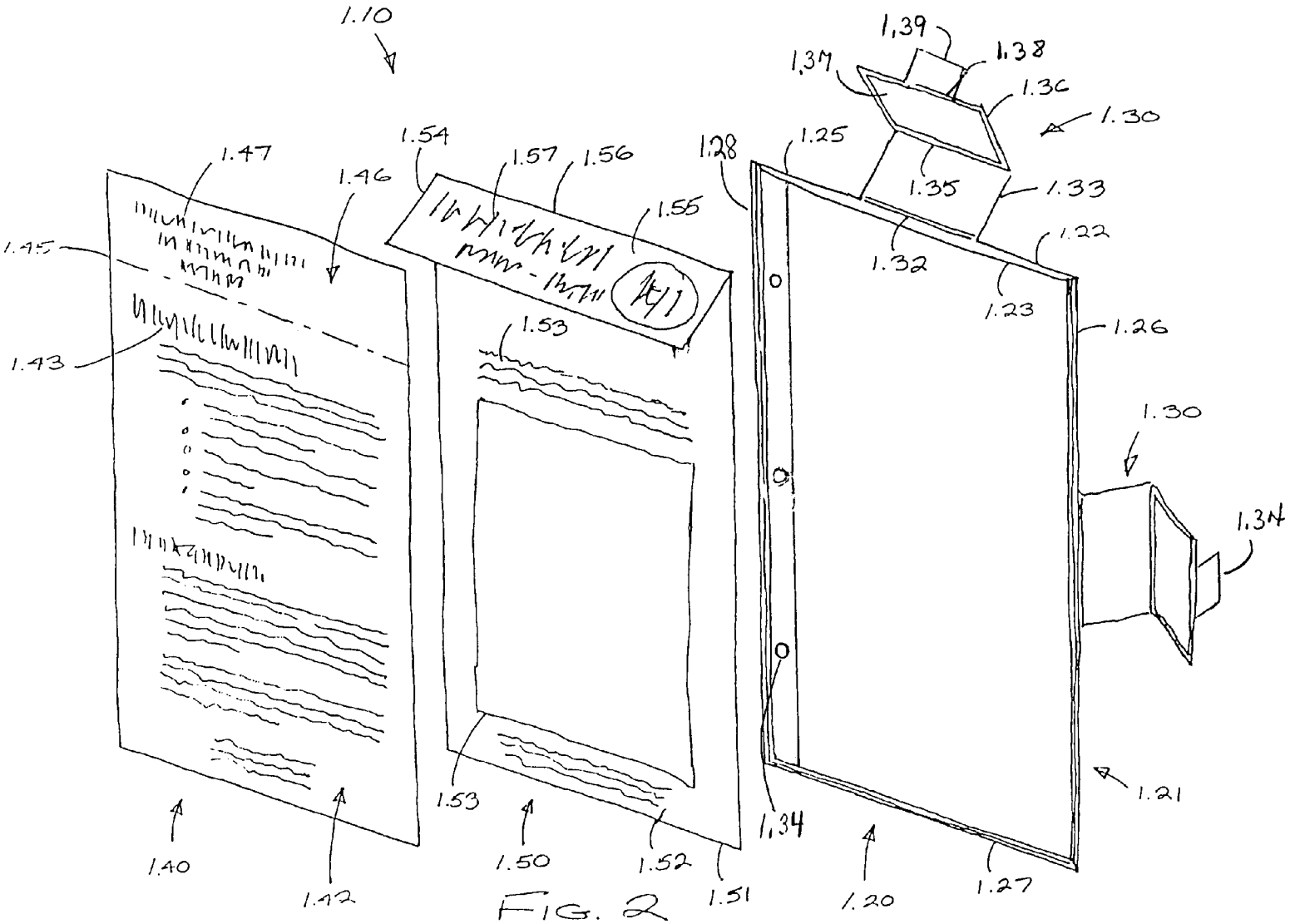
FIG. 2 is an oblique view exploded drawing of an information storage and display product 1.10 according to one embodiment of the present invention.

FIG. 2 shows a storage and display product 1.10 that is designed on the basis of the method of FIG. 1 to achieve the distinct objectives and advantages of the present invention. Indicia 1.40 is tangible information of the type procured from the indicia source described above, and as such may be of flimsy paper or plastic, or more rigid paperboard or plastic. A displayed indicia field 1.42 contains displayed indicia information 1.43 that suits the informational need of a given application. A concealed indicia field 1.46 is intended to be concealed when the display product is assembled according to the method of FIG. 1. A line 1.45 separating displayed indicia field 1.42 and concealed indicia field 1.46, while not required, preferably appears as a visual cue separating displayed indicia information 1.43 from concealed indicia field 1.46. Thus, line 1.45 suggests the proper placement of the indicia 1.40. That visual cue may be a dashed line, or a shaded field, or small print in the position of the line. It is readily apparent to one of ordinary skill in the art of the present invention that indicia 1.40 may be printed in the above manner on both sides of an opaque material, or may be printed on a transparent material, to suit a given application, and to provide as much information as possible.

Referring further to FIG. 2, holder 1.50 is of the type procured from the holder source of the method of FIG. 1, and as such is of a sufficiently rigid material, such as plastic or paperboard, to effectively and easily hold indicia 1.40 for insertion into a display unit. A concealed holder field 1.52 on a back portion 1.51 is intended to be concealed when the display product is assembled. A folded portion 1.54 has a displayed holder field 1.55 on which is printed displayed holder information 1.57. In the preferred embodiment, holder 1.50 is made from a single sheet of material folded once at fold line 1.56 which may be folded in manufacturing or by the user. While holder 1.50 is shown with a single, rectangular folded portion 1.54 along the top edge of the holder 1.50, it should be readily apparent to one of ordinary skill in the art of the present invention that holder 1.50 may incorporate more than one folded portion 1.54, along any number of sides of holder 1.50, and that folded portion 1.54 may have a rounded or tabbed or trapeziodal shape. Folded portion 1.54 may also be of the same size and shape of back portion 1.51 and contain an aperture through which indicia information is viewed. It is further apparent that back portion 1.51 and folded portion 1.54 may have concealed holder information 1.53 and displayed holder information 1.57 printed on both sides, to enhance the purposes of compelling display of the holder display information, or maximizing the amount of holder information that may be imprinted.

Referring further to FIG. 2, display 1.20 is made of a flexible, clear plastic sheet material. Front portion 1.22 and rear portion 1.23 are permanently bonded at first side edge 1.26, bottom edge 1.27, and second side edge 1.28, to form a pocket portion 1.21 into which the combined indicia 1.40 and holder 1.50 are inserted. Second side 1.28 is three-hole punched 1.34 through the bonded second side edge to allow for storage of display 1.20 in a three-ring binder, if desired. Top edge of front portion 1.22 and rear portion 1.23 are not bonded, and a plurality of indexing tab portions 1.30 are permanently attached to the above disclosed edges of display 1.20. In the preferred embodiment, one tab portion 1.30 is permanently attached to rear portion 1.23 at top edge 1.25, and one tab portion 1.30 is permanently attached to first side edge 1.26. In this manner, display 1.20 may conveniently be secured to a surface with the top edge facing upwards, placing the display 1.20 in a portrait orientation, or may just as conveniently be secured to a surface with the first side edge facing upwards, placing the display 1.20 in a landscape orientation, depending upon the particular application.

It should be readily apparent to one of ordinary skill in the art of the present invention that display 1.20 may incorporate one, two, or more than two tab portions 1.30 for the purpose of displaying the assembled display product 1.10 from either side on a surface, or of holding the combined indicia 1.40 and holder 1.50 in the display 1.20.

In the first embodiment, tab portions 1.30 comprise a first seam 1.32 flexibly attaching first tab portion 1.33 to the corresponding edge of the display pocket portion 1.21. Second seam 1.35 flexibly attaches the distal edge of first tab portion 1.33 to second tab portion 1.36. Second tab portion 1.36 incorporates a well known and commercially available releasable, reusable adhesive applied to adhesive regions 1.37 on both sides of second tab portion 1.36. Third seam 1.38 flexibly attaches the distal edge of second tab portion 1.36 to third tab portion 1.39.

The process of FIG. 1, and the objectives of the present invention, are accomplished by the product of the present embodiment in the following manner. The selected side of indicia 1.40 is placed against the selected side of back portion 1.51 of holder 1.50. Folded portion 1.54 of holder 1.50 is folded along fold line 1.56 to form a rigid and convenient structure comprising the combined indicia 1.40 and holder 1.50, to display the displayed holder information 1.57 and displayed indicia information 1.43. This combined indicia 1.40 and holder 1.50 is placed completely within pocket portion 1.21 of display 1.20, with displayed indicia information 1.43 and displayed holder information 1.57 observable through front portion 1.22. Second tab portions 1.36 are folded along second seams 1.35 and releasably attached to first tab portions 1.33 by way of one of the two releasable adhesive regions 1.37. Second tab portions 1.36 are folded towards front portion 1.22 if adhesive attachment of the display to a surface is desired, while second tab portions 1.36 are folded towards rear portion 1.23 if adhesive attachment is not desired. In this manner, when first tab portion 1.33 joined with second tab portion 1.36 is subsequently folded over rear portion 1.23 of pocket portion 1.21, a releasable adhesive region 1.37 is either presented or concealed, as the user desires.

In this manner, the tab portions 1.30 of the display 1.20 are folded in such a manner as to reveal or obscure releasable, reusable adhesive regions 1.37 of the tab portions 1.30. If display on a flat surface such as a wall, cabinet, or appliance is desired, the tab portions 1.30 are folded to reveal releasable, reusable adhesive regions 1.37 for attachment to those surfaces. If storage in a file, bag, or pocket is desired, the tab portions 1.30 are folded to cover the releasable, resusable adhesive regions, so that they do not inadvertently adhere to a surface. It is in the manner in which the display portion can hold the displayed indicia in either position, and showing either side, that is one of the novel features of the present invention.

Expanding on the above example, if the application is the provision and organization of food recipes and nutritional information in a proprietary format, displayed holder information 1.57 may be source identity or promotional information, and displayed indicia information 1.43 may be the food recipe and nutritional information about the particular recipe.

Figure 3:
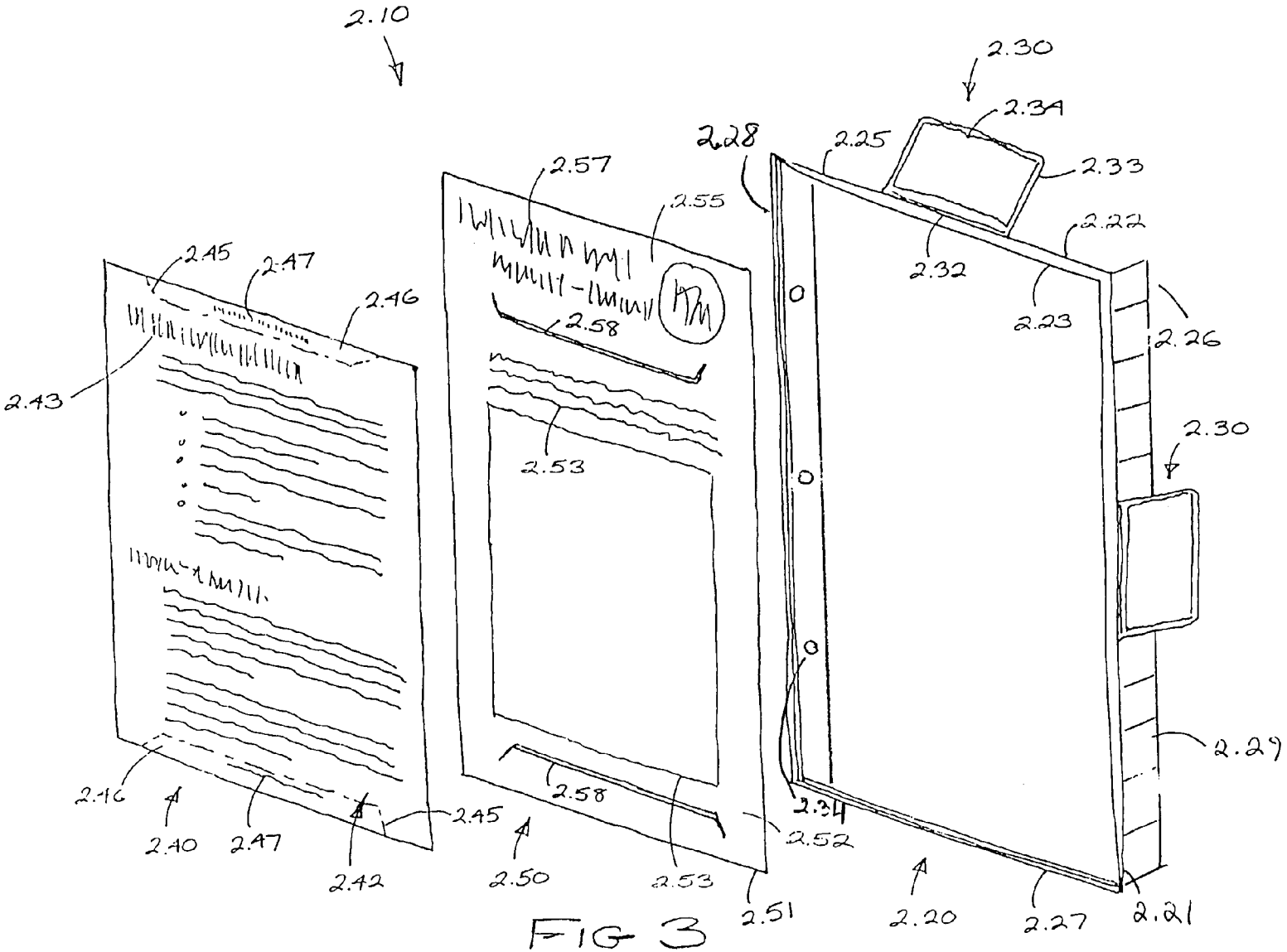
FIG. 3 is an oblique view exploded drawing of an information storage and display product 2.10 according to another embodiment of the present invention.

FIG. 3 shows a storage and display product 2.10 according to a second embodiment of the present invention that also facilitates the method of FIG. 1, and meets the objectives of the present invention. Note that the decimal reference numerals in FIG. 3 are intended by their prefix "2" to denote the second embodiment, the suffix to denote part number, and like suffixes used in FIGS. 2 and 3 denote like components (e.g., 1.50 and 2.50 are an identical holder, 1.57 and 2.57 identical holder information, and 1.53 and 2.53 identical concealed holder information. In this embodiment, indicia 2.40 incorporates two concealed indicia fields 2.46 adjacent to opposite edges of indicia 2.40. Two lines 2.45 separate concealed indicia fields 2.46 from displayed indicia field 2.42 on which displayed indicia information 2.43 is printed. The desired side of the indicia 2.40 selected from an indicia source is placed under two die cut tabs 2.58 cut into holder 2.50, revealing the displayed indicia information 2.43 and displayed holder information 2.57, yet covering concealed holder information 2.53.

Referring further to FIG. 3, display 2.20 has front portion 2.22 and rear portion 2.23 permanently bonded on only bottom edge 2.27 and second side edge 2.28, leaving top edge 2.25 and first side edge 2.26 open to receive the combined indicia 2.40 and holder 2.50. Second side 2.28 is three-hole punched 2.34 through the bonded second side edge to allow for storage of display 2.20 in a three-ring binder, if desired This embodiment of the display 2.20 is more facile for insertion of the combined indicia 2.40 and holder 2.50. Furthermore, in this embodiment tab portions 2.30 comprise a single tab portion 2.33 connected to front portion 2.22 of pocket portion 2.21 by way of a single seam 2.32, and have a single releasable adhesive portion 2.34 applied to the face of single tab 2.33 facing rear portion 2.23. In this manner, single tab portions 2.33 are folded over single seam 2.32 to adhere to rear portion 2.23 to conceal the single releasable adhesive portion 2.34 if desired, and single tab portions 2.33 are folded over single seam 2.32 to rest against front portion 2.22 in a non-adhesive manner to reveal the single releasable adhesive portion 2.34. Horizontal seals 2.29 are folded to seal first side edge 2.26 at the appropriate position, after insertion of indicia and holder. This manner of structure of tab portions 2.30 is of simpler and more facile manufacture than tab portions 1.30 of the first embodiment, but is not preferred because if the user wishes to reveal single releasable adhesive portions 2.34, the tab portions 2.30 do not cover the opening formed in the top edge 2.25 and first side edge 2.26 of the pocket portion 2.21, and the single tab portions are not adhesively attached to front portion 2.22 when they are folded in that manner. In this embodiment, indicia can be substantially smaller than in the first embodiment, although when inserted into the folding indicia holder, some of the field of the indicia is thereby obscured.

In the above embodiments, storage and display product 1.10, 2.10 is sized to suit the informational and organizational application at hand, and it is readily apparent that the storage and display product 1.10, 2.10 may be of nearly any size or aspect ratio desired. Furthermore, provision of the storage and display product 1.10, 2.10 in a proprietary format, not met by the use of conventional card or paper indicia sizes, enhances the use of the method to display holder information and indicia information in the format desired by the application provider. As should be apparent to one of ordinary skill in the relevant art, for a given size of application, the display 2.20 of FIG. 3 can be used with the holder 1.50 and indicia 1.40 of FIG. 2, and vice versa.

Furthermore, display 1.20, 2.20 may incorporate a flange portion (not shown) extending from one edge of the display, wherein a plurality of holes are punched for application of the display in a well known binder. Well known and commercially available three-ring, seven-ring, or other binders may be used, or binders may be provided in a proprietary format. Such a binder could then serve as both display source, holder source, and indicia source, if desired. A plurality of displays 1.20, 2.20 may be spiral bound, in an album, and a single display can be removed from the binder and adhesively applied to a surface.

Figure 4:
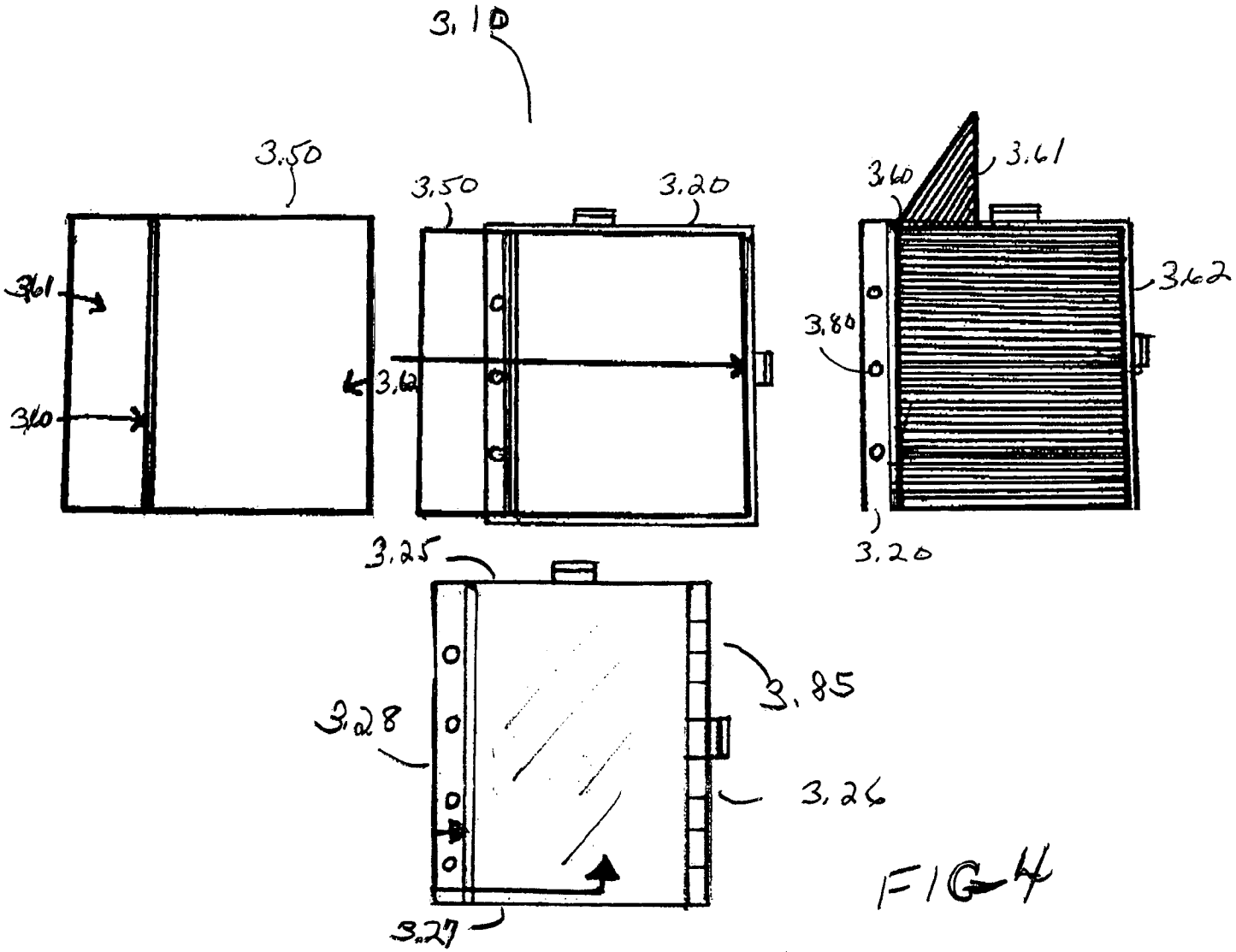
FIG. 4 is an oblique view exploded drawing of an information storage and display product 3.10 according to a third embodiment of the present invention.

FIG. 4 shows a storage and display product 3.10 according to a third embodiment of the present invention that also facilitates the method of FIG. 1 and meets the objectives of the present invention. In this embodiment, the easel 3.10, formed of rigid material, such as plastic or cardboard, is scored at 3.60 creating two distinct joined parts 3.61 and 3.62 that may be folded at the score 3.60 to form a 45 to 90 degree angle. The easel 3.50 is inserted flat into the two-sided see-through plastic display 3.20. Easel 3.50 is folded on score 3.60, creating a rear 3.61 and front 3.62 portion whereby said portions form an angle. The storage and display product 3.10 can thus stand freely on a table top or counter for viewing by the user, without the need for any other support means. The front portion 3.22 and rear portion 3.23 of display 3.10 are permanently bonded on the top edge 3.25, bottom edge 3.27, and first side edge 3.26, leaving second side edge 3.28 open to receive the combined indicia 3.40 and holder 3.50. A plurality of holes 3.80 are punched along the edge of the second side 3.28, to allow for storage of display in a three-ring binder. A plurality of embossed index tabs 3.85 are attached to the edge of first side edge 3.26. The index tabs can be used to identify a particular display when stored in a binder.

Figure 5:
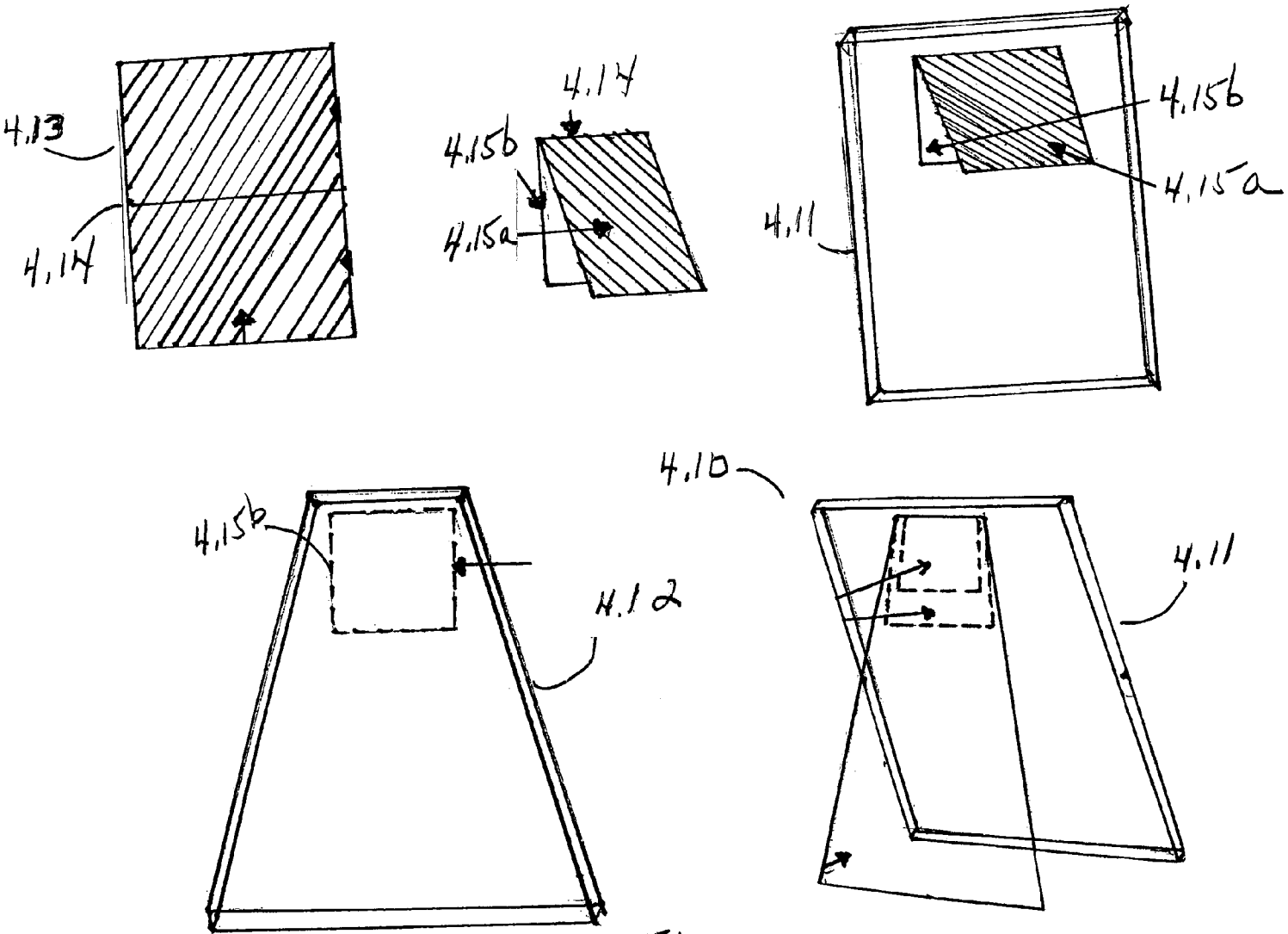
FIG. 5 is an oblique view exploded drawing of an information storage and display product 2.10 according to a fourth embodiment of the present invention.

FIG. 5 is an oblique view exploded drawing of an information storage and display product 4.10 according to a fourth embodiment of the present invention. In this embodiment, display pocket 4.11 is adhesively attached to and easel 4.12, allowing the information and display product 4.10 to sit atop a table or other like flat surface. A hinged vinyl sticker 4.13, with adhesive on one side, is used to adhere the easel 4.12 to display pocket 4.11. The vinyl sticker 4.13 is scored at 4.14 to enable the sticker to be folded, creating two distinct adhesive sides 4.15*a* and 4.15*b*. Adhesive side 4.15*b* is adhesively attached to the back of display pocket 4.11, leaving adhesive side 4.15*a* to attach to an easel 4.12 made of plastic or paper board, or other rigid material. In this manner, the information storage and display product 4.10 is free-standing and may be displayed on a table or counter top.

Figure 6:
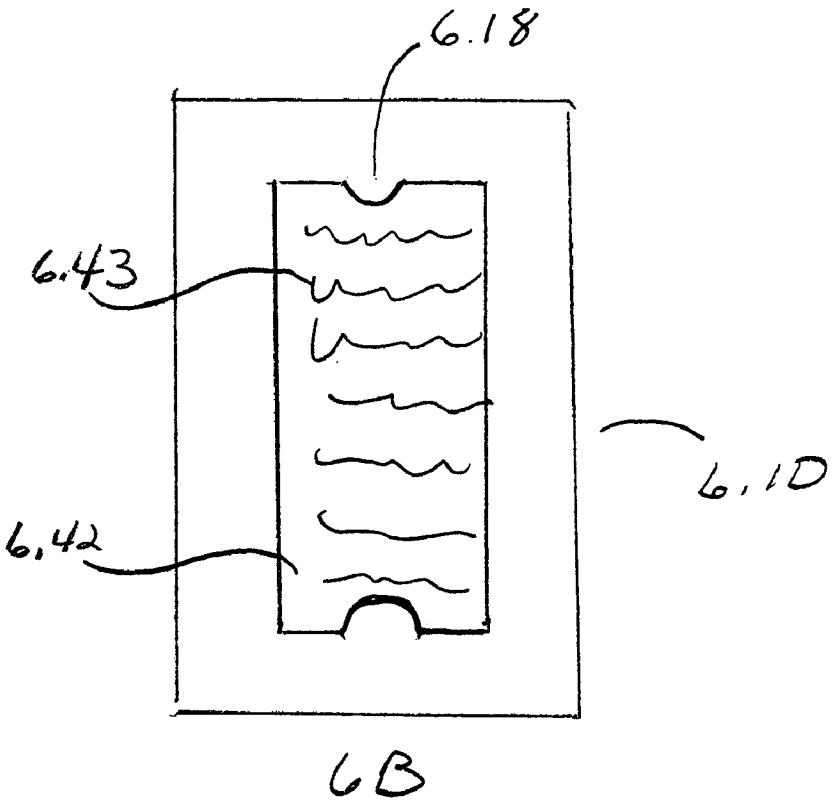
FIGS. 6A and 6B are oblique views of exploded drawings of an indicia holder and display unit 3.10 according to the present invention.
Figure 6:
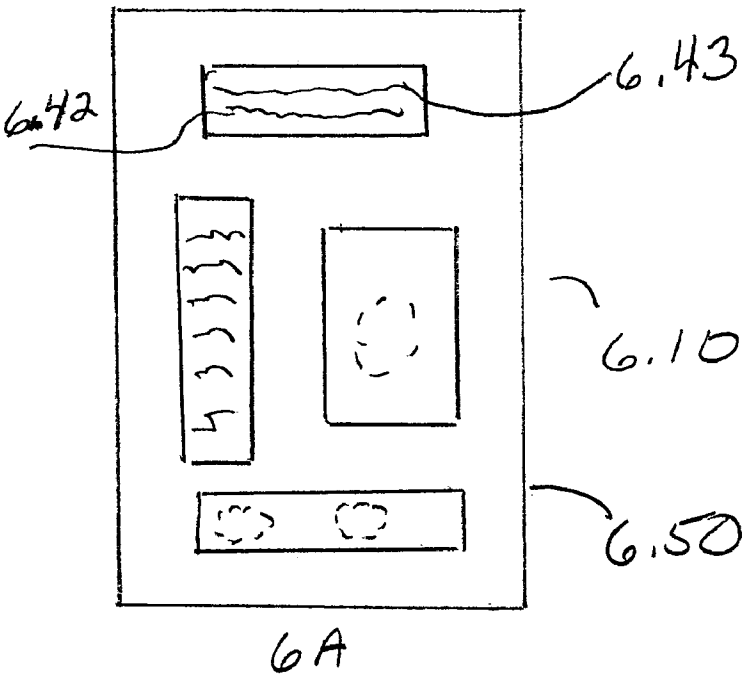

FIGS. 6A and 6B show alternate embodiments for displaying indicia information 6.43 that suit the informational needs of a given application. Referring now to FIG. 6A, indicia information 6.43 are displayed on an indicia field 6.42. In FIG. 6A, the indicia fields 6.42 are adhesively attached to various portions of the indicia holder 6.50, and are particularly useful for displaying multiple types if indicia information 6.43, such as web page prints, newspaper clippings, magazine cut-outs, notices, and recipes that are adhered to said indicia holder 6.50 by means of double-faced adhesive cut-outs. Referring to FIG. 6B, a full page of indicia information 6.43 is displayed on an indicia field 6.42. Die cut tabs 6.18 in the indicia holder 6.50 hold the indicia field 6.42 in place. The indicia holder 6.50 are made of rigid material and may be printed with decorative designs, logos, slogans and information related to the indicia text or subject.

Figure 7:
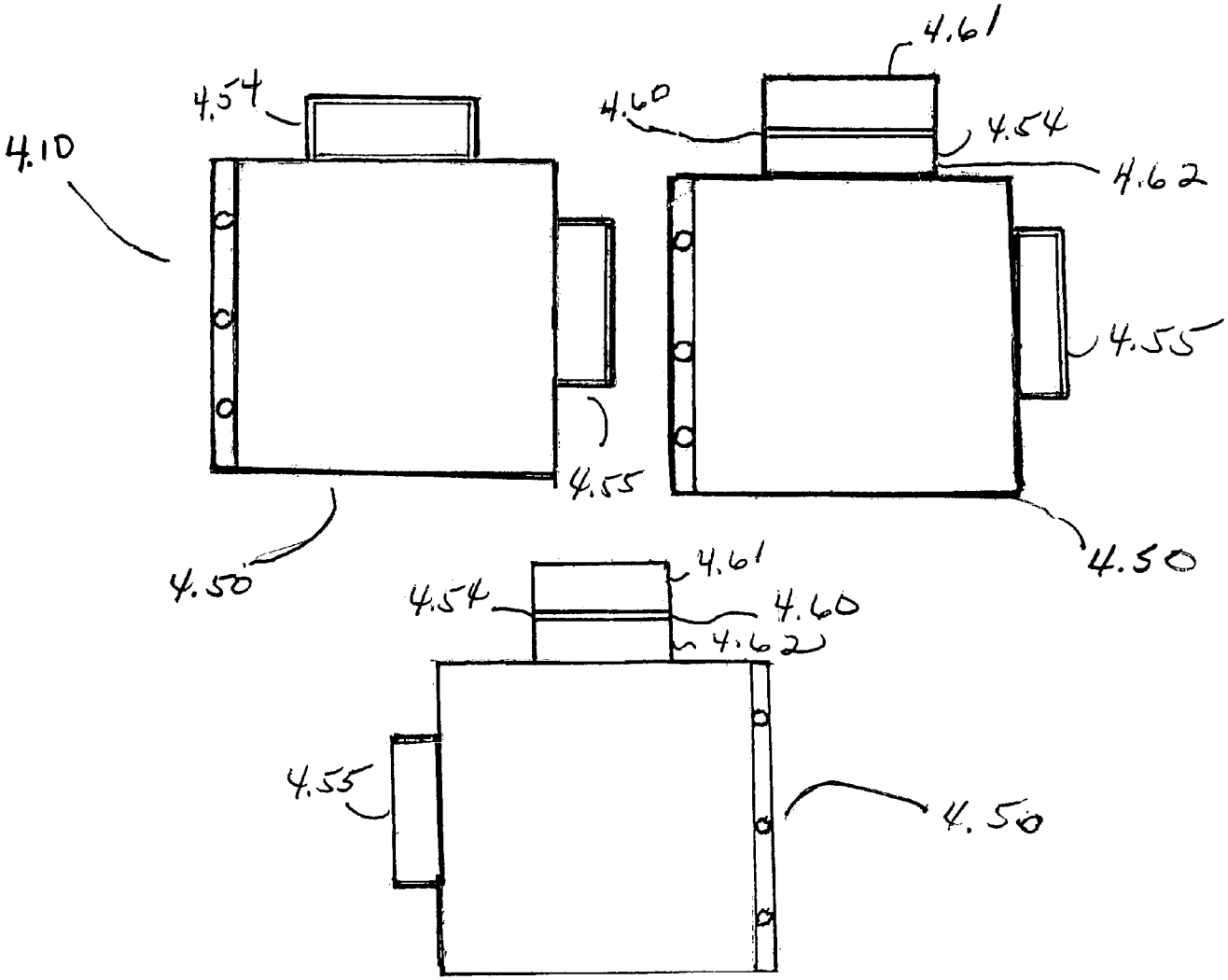
FIG. 7 is an oblique view exploded drawing of an information storage and display product 4.10 according to another embodiment of the present invention

FIG. 7 shows a storage and display product 4.10 according to another embodiment of the present invention that also facilitates the method of FIG. 1 and meets the objectives of the present invention. In this embodiment, FIG. 7 shows a storage and display product 4.10 that is designed on the basis of the method of FIG. 1 to achieve the distinct objectives and advantages of the present invention. It is readily apparent to one of ordinary skill in the art of the present invention that indicia may be printed on both sides of an opaque material and displayed from either side of the storage and display product.

Referring further to FIG. 7, holder 4.50 is made of a clear, sufficiently rigid material, such as plastic, to effectively display indicia from either side of holder 4.10. A flap tab portion 4.54 is attached along the top edge of the holder 4.50 and another flap tab portion 4.55 is attached along the first side of the holder 4.50. Flap tabs 4.54 and 4.55 are folded at the seam 4.60 creating a top 4.61 and bottom 4.62 side of the flap tab 4.64. A commercially available releasable, reusable adhesive is applied to the front and back side of the top portion 4.61 of the flap tab 4.54 so that, when folded forward or backward in the closed position, the top portion 4.61 of the flap tab 4.54 can be easily attached to or removed from a surface. When the top portion 4.61 of the flap tab 4,54 is folded forward, the back side of the top portion 4.61 faces the front and the front of flap tap 4.54 may be adhesively attached to a surface. Likewise, when the top portion 4.61 of the flap tab 4.54 is folded backward, the front side of the top portion 4.61 faces the back and the back of the flap tab 4.54 may be adhesively attached to a surface. A plurality of holes 4.80 are punched along the edge of the second side 4.28, to allow for storage of display in a three-ring binder.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein. By way of example, back portion 1.52 of holder 1.50 or concealed indicia field 1.46 of indicia 1.40 may incorporate releasable adhesive of well known and commercially available type to further releasably join indicia 1.40 and holder 1.50. By way of further example, a number of indicia 40 can be held at one time in holder 50 in an interchangeable manner. By way of further example, the method of FIG. 1 may easily be practiced using an indicia 40 that is itself folded from a larger sheet of material, so that four or eight indicia are presented on a single sheet, and are scored for folding into the desired configuration for placement into a holder. By way of further example, display 20 may be made of such a clear plastic material as would be easily marked and erased by grease pencil or erasable marker, to suit the desired application, such as the provision of a checklist for medical, factory, or custodial work.

We claim:

1. A method for the storage, organization, indexing, retrieval, and display of information comprising the steps of:

selecting one or more indicia from an indicia source, each of said indicia having indicia information;

selecting one or more holders from a holder source, each of said holders having holder information;

applying one or more of said indicia to each of said holders, to form a combined indicia and holder;

selecting a display from a display source for each of said holder selected, wherein said display comprises a pocket portion and at least one flap tab portion, said flap tab portion hingedly attached to an edge of said display about a seam, and having a reuseable adhesive material affixed to one side of said flap tab portion;

inserting said combined indicia and holder into said pocket portion of said display, displaying said displayed indicia information and displayed holder information;

selecting between folding said flap tab portion in a first direction about said seam to conceal said reuseable adhesive portion of said flap tab, and in a second direction about said seam to reveal said adhesive portion and to enable attachment of said revealed adhesive portion of said display to a secondary surface.

* * * * *